US006592011B1

(12) United States Patent
Lammel et al.

(10) Patent No.: US 6,592,011 B1
(45) Date of Patent: Jul. 15, 2003

(54) CHILD-PROOF AEROSOL DISPENSER

(75) Inventors: Michael Lammel, Aachen (DE); Bertrand Illert, Aachen (DE); Nills Muller, Aachen (DE)

(73) Assignee: S. C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 10/209,689

(22) Filed: Aug. 1, 2002

(51) Int. Cl.[7] ..... B65D 83/00; B67B 5/00
(52) U.S. Cl. ..... 222/402.11; 222/182; 222/153.11
(58) Field of Search ..... 222/182, 183, 222/402.11, 402.13, 153.11, 153.13

(56) References Cited

U.S. PATENT DOCUMENTS 5,358,147 A * 10/1994 Adams et al. ..... 222/183
5,487,489 A * 1/1996 Weiss et al. ..... 222/1
5,862,950 A * 1/1999 Holman ..... 222/383.1

* cited by examiner

*Primary Examiner*—Kevin Shaver
*Assistant Examiner*—Stephanie Willatt

(57) ABSTRACT

A novel dispenser for aerosols is disclosed. The aerosol dispenser has a provision for holding the aerosol container, an upper section which can be locked to prohibit downward pressure on the aerosol valve stem, but which can be readily unlocked to permit use of the aerosol. The lock or catch mechanism prevents inadvertent or accidental discharge of the aerosol contents.

9 Claims, 3 Drawing Sheets

CHILD-PROOF AEROSOL DISPENSER

CROSS-REFERENCE TO RELATED APPLICATIONS

Not applicable

STATEMENT REGARDING FEDERALLY SPONSORED RESEARCH

Not applicable

BACKGROUND OF THE INVENTION

Liquid dispensers used in and around the home can be utilized for the application of fragrances to improve home ambience, for improving sanitation, to help cleanse, the removal of unpleasant odors, and for the easy application of cleaners to improve the appearance and sanitation of the home to name only a few potential applications. Often these dispensers, particularly aerosol dispensers are utilized on or near horizontal surfaces such as on tables, kitchen countertops, bathroom vanities, bookshelves, and the like.

One of the hazards of utilizing an aerosol dispenser on a horizontal surface of this type is the danger of accidental or unintentional activation releasing active material when it is inappropriate or undesirable. Additionally, aerosol containers found in the home are available to minor children who may accidentally activate the aerosol spray do to their inherent curiosity. The present invention is directed at a liquid dispenser, and particularly an aerosol dispenser that can be utilized on a horizontal surface, can be easily placed in a mode where initial activation of the aerosol is difficult, and which, in the locked position, is less prone to accidental or inadvertent activation than conventional aerosol or liquid dispensers.

The dispenser of the invention provides for a simple activation or deactivation of a locking feature. The locking feature requires a user to knowingly unlock the device to remove the contents of the aerosol. The dispenser of the instant invention can be readily unlocked by actuating a lever located within the dispenser, thereby releasing a latch means before the valve stem of the aerosol container can be depressed, and the contents removed.

It is accordingly an object of this invention to provide to the art an aerosol or liquid dispenser which can be conveniently disabled to prevent the aerosol or liquid from dispensing, but, which can be conveniently and quickly reactivated to enable the dispenser to release the active liquid or substance in the aerosol or liquid container.

It is a further object of the invention to provide to the art an aerosol dispenser that is attractive, functional, and provides a locking feature to prevent accidental discharge of the aerosol container contents. It is a still further object of this invention to provide to the art an aerosol dispenser for use on horizontal surfaces which the consumer can set to prevent accidental or inadvertent discharge of the content of the aerosol. Further objects will appear hereinafter.

BRIEF SUMMARY OF THE INVENTION

The aerosol dispenser of the present invention can be generally described as having t he following structure and characteristics.

a.) an upper holder section and a lower holder section, the lower holder section containing therein a substantially vertically disposed aerosol container containing an aerosolizable fluid said container having a valve activated to an open position by downward force on a valve stem communicating with the valve;

b.) A flow channel in the upper holder section, said channel having an interior channel fluid opening and an exterior channel outlet, the interior channel fluid opening adapted to receive the valve stem, the exterior channel outlet being open to the environment, hinge means connecting the upper holder section with the lower holder section in a manner to establish flow contact between the valve stem and the interior channel fluid opening when downward pressure is exerted on the nonhinged side of the upper holder section;

c.) a semi-rigid first lever attached to the upper holder section and extending downward into an opening in the lower holder section, said first lever having latch means at the terminal end, said latch means removeably engaging latch receiving means in the bottom holder section to lock the top holder section and prevent the top holder section from being moved on the hinge means, said latch means when engaged with the latch receiving means is a sufficient distance from the attachment point of the first lever on the upper holder section to prevent compression of the valve stem in a downward direction; and, d.) a second lever attached proximate to the bottom of the lower holder and extending to a position proximate on the first lever to the outside surface of the latch means, means for reversibly actuating said second lever to a working position to removeably disengage the latch from the latch receiving means allowing the upper holder section to move in a hinged downward direction when downward pressure is exerted onto the upper holder section, whereby the interior channel fluid opening engages the aerosol valve stem to release the aerosol content through the channel and out the channel outlet and whereby the assembly can be relocked by reengaging the latch with the latch receiving means.

DETAILED DESCRIPTION OF THE PREFERRED EMBODIMENT

Figure 1:
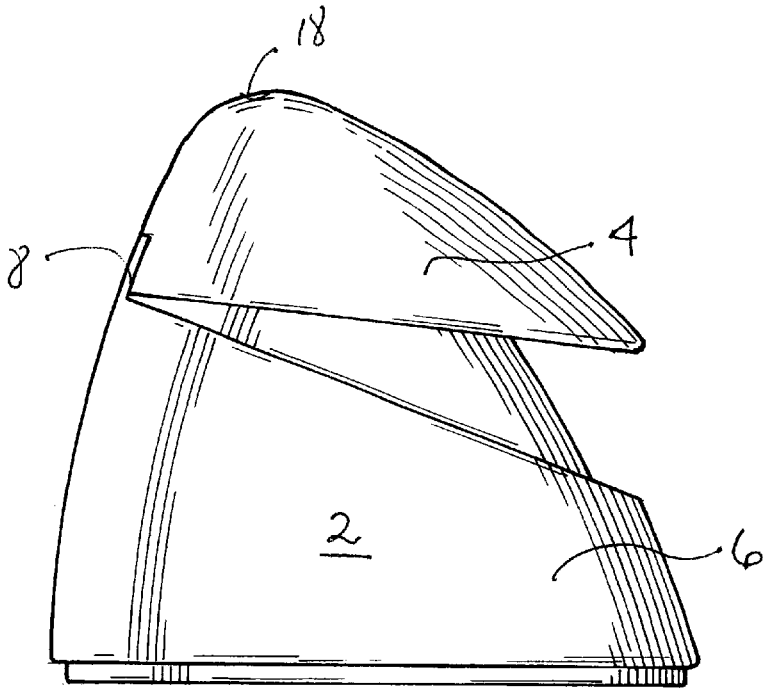
FIG. 1 shows an aerosol dispenser of the invention.

With reference to the drawings, FIG. 1 shows the exterior of an embodiment of the dispenser 2 of the instant invention. While a particular design is shown, it will be readily apparent to those skilled in the art that the design is not a part of this invention, and that the dispenser can be prepared in any number of esthetic variations. Dispenser 2 has upper section 4 and lower section 6 connected by hinge means 8. Exit opening 18 in upper section 4 allows the content of the aerosol container, not shown in this view to discharge to the environment.

Figure 2:
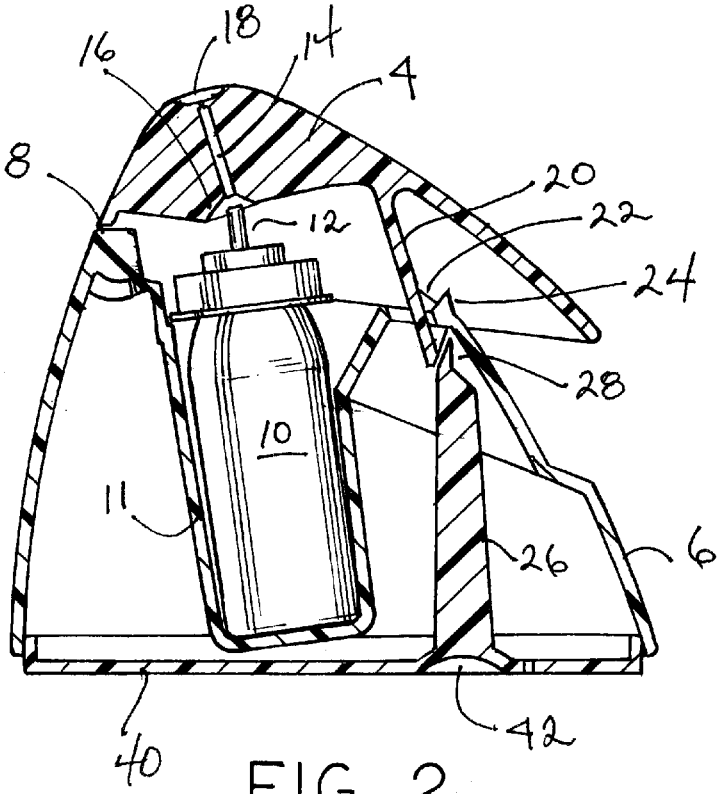
FIG. 2 shows a cut-away view of the aerosol dispenser of the invention.

FIG. 2 shows a cutaway cross-sectional view of the dispenser 2. In this view one can readily see the separation of upper holder section 4, lower holder section 6, and hinge means 8. Hinge means 8 can be designed to be an actual hinge material made of plastic, metal or the like, or can, in an inexpensive holder can be a pliable piece of plastic, preferably the same plastic from which upper and lower holder sections 4 and 6 respectively can be molded. Upper holder section contains channel 14 having exit opening 18 and entrance opening 12. Entrance opening 12 is designed to cooperate with valve stem 12 of aerosol container 10. Valve stem 12 interacts with a valve, not shown, in the aerosol container 10 so that when downward pressure is applied to top section 4, pressure is exerted on valve stem 12 which opens the aerosol valve, and causes fluid to enter channel 14 through opening 16 and exiting channel 14 through opening 18 into the atmosphere.

Container 10 is held in a substantially vertical position by structure 11. While structure 11 is depicted in this embodiment as a well into which the container is inserted, other means will be apparent to those skilled in the art to hold container in place. Also depicted in FIG. 2 is first lever 20 having latch means 22. Lever 20 is preferably made of a semi-rigid plastic which can bend when flexed as latch means engages and disengages latch receiving means 24 which is, in this embodiment part of lower holder section 6. Latch means 22 is shown as a hook which catches on latch receiving means 22. Other latch means can be utilized so long as the latch means can be released by a consumer so as to allow the contents of aerosol container to be discharged through opening 18. Latch means 22 and latch receiving means 24 are designed to function multiple times hence the receiving means must be of a hardness not damaged by use of latch means 22. In a preferred embodiment of the invention latch means 22 and latch receiving means 24 are made of the same material, the plastic from which upper and lower holder sections 4 and 6 respectively are molded.

Latch means 22 should be placed at or near the terminal end of first lever 20 so that lever 20 and latch means 22 interact with latch receiving means 24 at a distance holding upper holder section 4, and opening 16 at a position where it is proximate to, but not depressing valve stem 12 a sufficient downward distance to activate the valve of aerosol container 10 in a locked or engaged position. In designing the holder of the present invention it will be apparent that it is important that valve stem 12 be aligned with opening 16, and hinge means 8 should be designed with this feature in mind, or alternative means for aligning valve stem 12 with entrance to channel 16 should be employed, for instance if the hinge is constructed of a simple plastic strip rather than a more rigid plastic or metallic strip. In the embodiment shown, lever 20 and latch means 22 pass into lower holder section 6 through hole 30 in the structure of the lower holder section. The edge of lower holder section 6 acts as the latch receiving means 24 in this embodiment.

Second lever 26 extends from the bottom 40 of lower holder section 6. Bottom 40 is designed in this embodiment so has to have a flexible area to which the second lever is attached, allowing, when upward pressure is exerted on button 42, the upward movement of lever 26 causes the tip of the second lever to contact latch means 22, releasing latch means 22 from latch receiving means 24 when downward pressure is concurrently applied to upper holder section 4. Gentle application of pressure to button 42 and downward pressure to top holder section 4 at the same time releases latch means 22 from latch receiving means 24, allowing the upper holder section to move unimpeded in a downward direction, and allowing one to actuate aerosol container valve (not shown) by the pressure applied to valve stem 12. Upper holder section 4 remains available for use unless and until upward pressure is applied to top holder section 4, which reversibly sets the latch means 22 into latch receiving means 24. The application of pressure to the top holder section, which can be as light as the effect of gravity on the section concurrently with the operation of button 42 on bottom 40 operate to provide a child safety mechanism.

Figure 3:
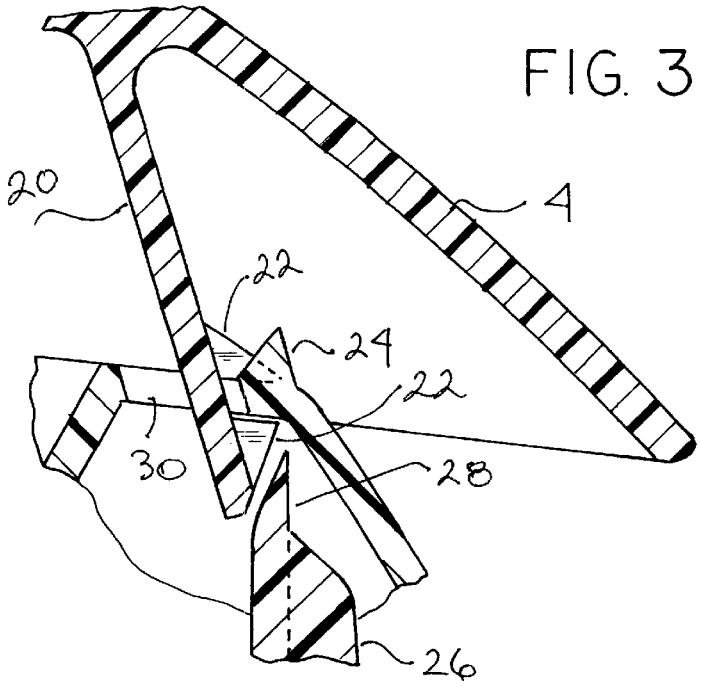
FIG. 3 shows a detailed view of the latch means and latch receiving means of the invention.

FIG. 3 shows detail of the latch means and latch receiving means of the present invention. As seen first lever 20 has catch means 22 at its terminal end which interacts through hole 30 to engage latch receiving means 24. Latch receiving means 24 may be nothing more than the far edge of hole 30 into which lever 20 must fit in order for unimpeded downward movement of the top section when the latch means is released or disengaged from the latch receiving means. Tip 28 of second lever 26 may be configured to specifically interact with the geometry of the latch means and latch receiving means so that upward pressure or force applied on lever 26 exerted through button 42 is efficiently used to release or disengage latch 22 from latch receiver 24. Tip 28 of lever 26 should be of a hardness equivalent to the construction of latch means 22 so that repeated use of lever 26 does not unreasonably wear latch 22. In a preferred embodiment, latch means, latch receiving means, lever 26, and tip 28 are all constructed out of the same type of semi-rigid plastic.

Figure 4:
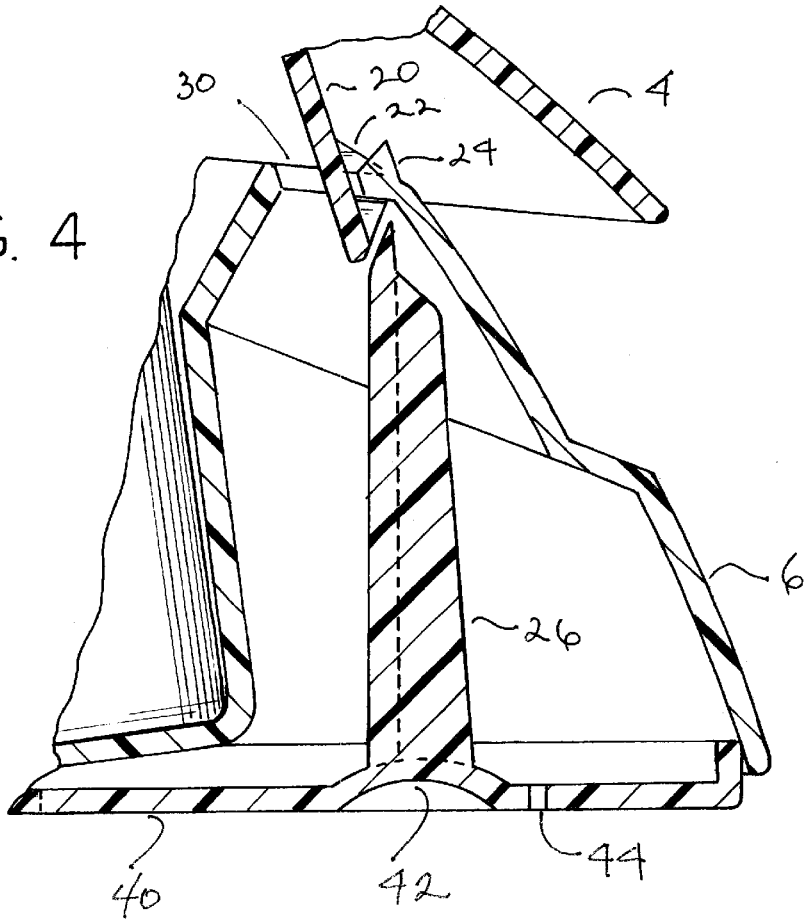
FIG. 4 shows a detailed view of the lever release mechanism useful to interact with latch means and latch receiving means.

FIG. 4 shows a close up of the cross-section of bottom 40 of bottom holder section 6 showing the position of lever 26 in conjunction with lever 20, latch mechanism 22, and latch receiving means 24.

Figure 5:
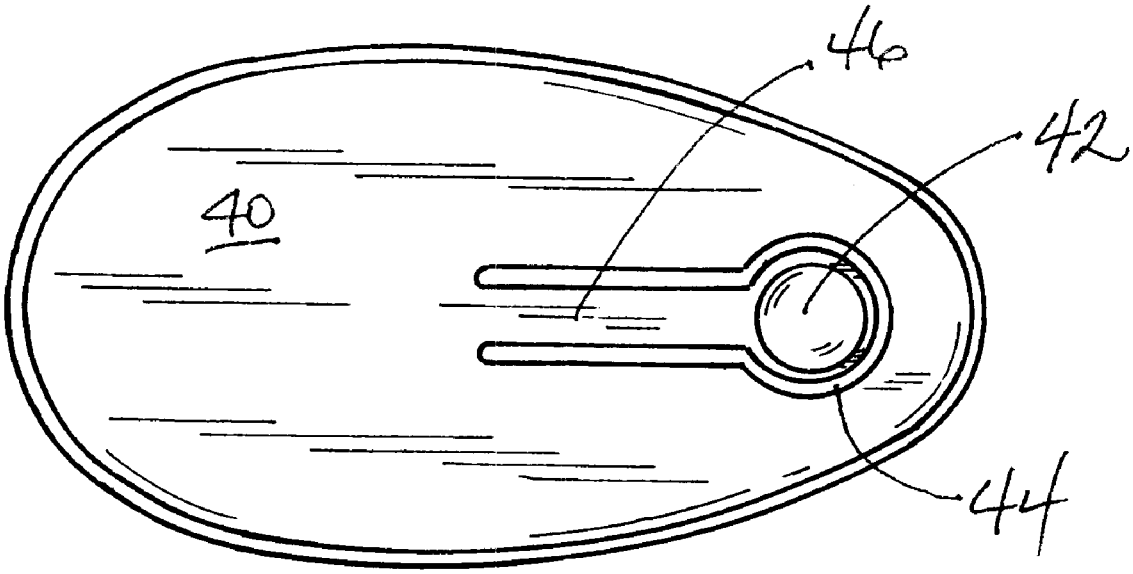
FIG. 5 shows the bottom surface of the aerosol dispenser, showing release button for the lever release mechanism.

FIG. 5 shows the bottom 40 of lower holder section 6 and button 42 having attached thereto on the reverse side, lever 26. As seen in the drawing button 42 is rounded, and is separated from the main body of bottom 40 by spacing 44 allowing button 42 to move freely in an up and down manner. Tail 46 of button 42 acts as a spring, bring button 42 back to its original position after having been utilized to release the latch mechanism. As will be seen by those skilled in the art, button 42 may be made of any convenient shape, and opening or spacer 44 can be of any reasonable dimension so as not to weaken bottom 40. While preferably made of the same semi-rigid plastic as upper holder section 4 and lower holder section 6, bottom 40 can be made of alternative materials such as tin or steel which can be formed to have spring 46 return to its original position.

The aerosol dispenser of the instant invention may also include other features in combination. For instance, it is often times advantageous, and is a preferred embodiment to utilize an aerosol container having a metered valve, so that upon depression, only a measured amount of aerosol content flows into the environment. Likewise, the aerosol holder of the invention can be appropriately decorated to fit into a room décor. The aerosol holder of this invention is particularly advantageously utilized with a concentrated fragrance or scent, but the holder will also function with other aerosol content, such as santization agents, insecticides, insect repellents, and deodorants. The holder when equipped with an aerosol container containing a concentrated fragrance, scent, or deodorizer is preferably utilized in the home, office, or auto, but the suggested location of the holder is not meant to be limiting.

As will be seen, changes can be made to the aerosol dispenser of the present invention without departing from the spirit and intent of the invention described herein. Different latch/latch receiver mechanisms may be employed. Likewise, the composition of the holder which has been described herein as preferably made of a rigid plastic material can be made of stamped metal components and the latch mechanism and levers fastened thereto with conventional fasteners or adhesives. The holder can be made in any appropriate size to house a given aerosol container without departing from the scope of this invention.

Industrial Applicabillty

The holder is useful for the dispensing of aerosol products.

Having thus described our invention, we claim:

1. A dispenser comprising:

a. an upper holder section and a lower holder section, the lower holder section containing therein a substantially vertically disposed aerosol container containing an aerosolizable fluid, said container having a valve activated to an open position by downward force on a valve stem communicating with the valve;

b. a flow channel in the upper holder section, said channel having an interior channel fluid opening and an exterior channel outlet, the interior channel fluid opening adapted to receive the valve stem, the exterior channel outlet being open to the environment, hinge means connecting the upper holder section with the lower holder section in a manner to establish flow contact between the valve stem and the interior channel fluid opening when downward pressure is exerted on the non-hinged side of the upper holder section;

c. a semi-rigid first lever attached to the upper holder section and extending downward into an opening in the lower holder section, said first lever having latch means at the terminal end, said latch means removeably engaging latch receiving means in the bottom holder section, to lock the top holder section and prevent the top holder section from being moved on the hinge means, said latch means when engaged with the latch receiving means is a sufficient distance from the attachment point of the first lever on the upper holder section to prevent compression of the valve stem in a downward direction; and, d. a second lever attached proximate to the bottom of the lower holder and extending to a position proximate on the first lever to the outside surface of the latch means, means for reversibly actuating said second lever to a working position to removeably disengage the latch from the latch receiving means allowing the upper holder section to move in a hinged downward direction when downward pressure is exerted onto the upper holder section, whereby the interior channel fluid opening engages the aerosol valve stem to release the aerosol content through the channel and out the channel outlet and whereby the assembly can be relocked by reengaging the latch with the latch receiving means.

2. The holder of claim 1 wherein the first lever is made of a semi-rigid plastic.

3. The holder of claim 2 wherein the upper and the lower holder sections are made of a semi-rigid plastic.

4. The holder of claim 3 wherein the aerosol valve is a metered valve.

5. The holder of claim 4 wherein the aerosolizable fluid is selected from the group consisting of fragrances, perfumes, santitation agents, insecticides, insect repellents, and deodorants.

6. The holder of claim 3 wherein the latch is a cut in the first lever adapted to engage the edge of the opening in the lower holder section.

7. The holder of claim 6 wherein the second lever is reversibly actuated by pressing a button cut-out on the bottom of the lower holder section.

8. The holder of claim 7 wherein downward pressure on the upper holder section and actuation of the second lever are performed concurrently to release the latch from the latch receiving means.

9. The holder of claim 1 wherein the latch means is a hook and the latch receiving means is a protrusion adapted to engage the hook.

* * * * *